United States Patent [19]

Fine

[11] Patent Number: 4,995,516

[45] Date of Patent: Feb. 26, 1991

[54] CLOTHES HANGER STRUCTURE

[76] Inventor: James M. Fine, P.O. Box 330489, Miami, Fla. 33233

[21] Appl. No.: 434,710

[22] Filed: Nov. 13, 1989

[51] Int. Cl.[5] ..... A47F 5/08

[52] U.S. Cl. ..... 211/87; 223/85

[58] Field of Search ..... 211/87, 119; 223/85, 223/88, 92, 95

[56] References Cited

U.S. PATENT DOCUMENTS

| | | | |
|---|---|---|---|
| 2,194,191 | 3/1940 | Wolf | 223/95 X |
| 2,915,232 | 1/1959 | Deucher | 223/88 |
| 3,485,423 | 12/1969 | Wagar et al. | 223/85 |
| 4,209,156 | 6/1980 | Kashden | 223/95 X |
| 4,560,071 | 12/1985 | Downing et al. | 211/87 X |
| 4,615,447 | 10/1986 | Walter | 223/95 X |

*Primary Examiner*—Blair M. Johnson

*Attorney, Agent, or Firm*—Malloy, Downey & Malloy

[57] ABSTRACT

A hanger structure primarily designed to hang, fold or support clothes, particularly slacks or like articles, within a locker or the like wherein the hanger structure includes a mounting component formed on one end of an elongated support arm so as to substantially orient the support arm in a horizontal position while removably supporting the hanger structure by a substantially cantilevered attachment to a mounting hook or like element secured to a vertical wall surface within the locker.

1 Claim, 1 Drawing Sheet

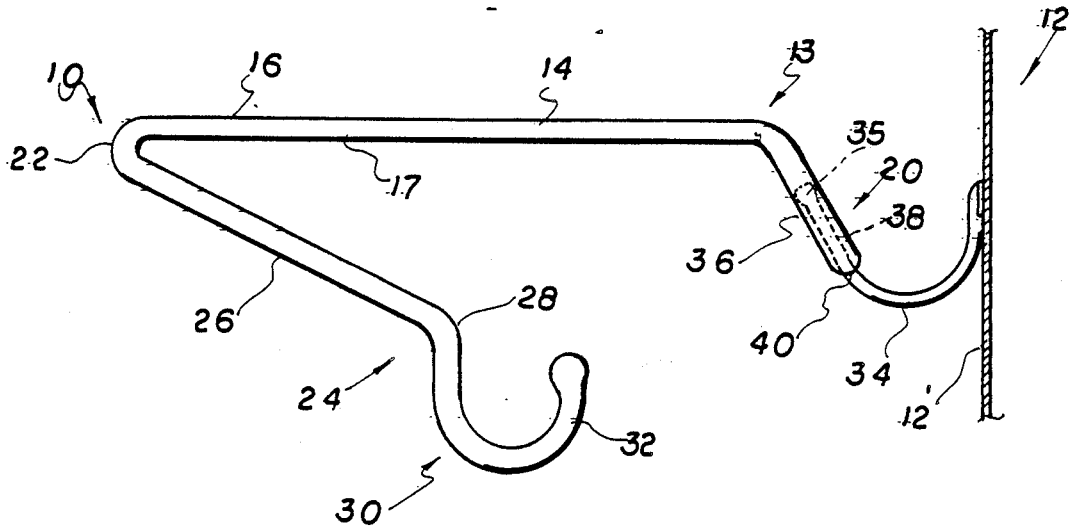
FIG. 2
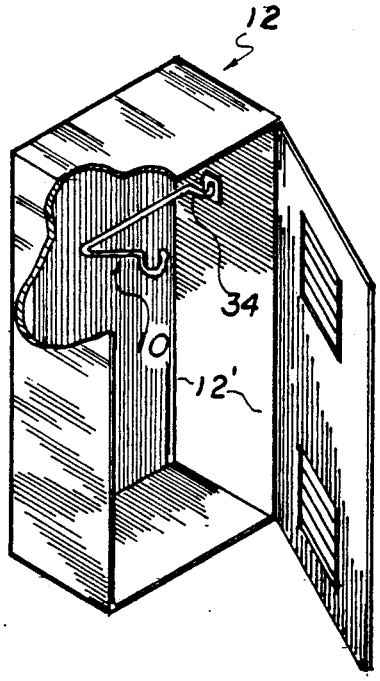
FIG. 1
FIG. 3
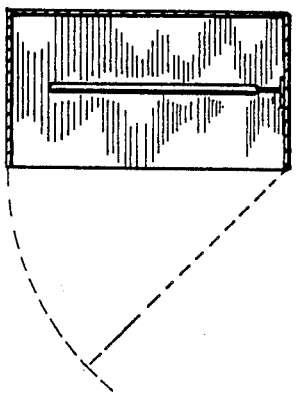
FIG. 4
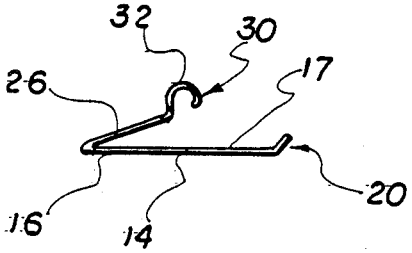

CLOTHES HANGER STRUCTURE

BACKGROUND OF THE INVENTION

1. Field of the Invention

The present invention relates to a clothes hanger particularly adapted for the mounting on a typical hook structure in a clothes locker of the type typically found in gymnasiums or the like in a manner which will support articles of clothing while allowing the transporting of such clothing from the locker to a conventional closet and clothes rod for hanging support therein.

2. Description of the Prior Art

Clothes hangers of the type usually including a support frame and hook like support element are well known in the prior art and commonly used in the conventional manner. Such conventional manner normally calls for slacks to be folded over and supported from a support arm having its opposite ends connected generally to two brace elements. The brace elements convert at a junction whereat the supporting hook is normally attached. Such a clothes hanger structure is commonly used for removable support of the article of clothing within a closet or the like on a elongated clothes rod. While such hanger structures are obviously well accepted by the consuming public, they do not generally lend themselves for use in many other applications.

In gymnasiums and like facilities used for physical exertion, the user of such facilities typically place their street clothes, for storage, within a locker type structure. Generally, in order to conserve space, such lockers are not sufficiently dimensioned or internally structured for adaptation to the use of conventionally configured clothes hangers of the type set forth above and well known in the prior art. The result is, users of such facilities are required to hang their clothes on support hooks attached to the inside vertical walls of the locker or otherwise fold or arrange their clothes in an inconvenient manner which facilitates wrinkling or unsatisfactory storage of such clothing articles.

While various hanger type structures may have been specifically developed in the prior art for specific application such as for use in trunks or like luggage, there does not appear to be any known prior art device which is used specifically for the hanging and support of articles of clothing, including slacks, in a gymnasium type locker. Such a preferred clothes hanger would be readily adaptable for transporting the articles of clothing from the locker if the user thereof chooses not to change back into his street clothes after exercising. Further, such a preferred hanger structure would be readily adaptable for use in the conventional manner for supporting articles of clothing in a closet of the type having an elongated clothes rod for the support of a plurality of such hangers.

Hanger structures for the support of articles of clothing are generally represented in the following U.S. Pat. Nos. 2,701,082; 4,131,817; 3,451,601; 4,485,423; and 4,529,110.

SUMMARY OF THE INVENTION

The present invention relates to a hanger structure particularly adapted for support of clothes articles within a gymnasium type locker of relatively small dimension. Typically, the transverse dimension within the interior of such a locker structure is approximately twelve to fourteen inches. Accordingly, there is no room in such locker structures for a typical clothes rod and accordingly, no use or room for a conventional clothes hanger with a hook like supporting member for removable attachment of such clothes hangers to a support rod. The present invention comprises an elongated support arm preferably having a linear configuration and capable of allowing articles, such as but not limited to, slacks or the like to be folded or draped thereacross in transverse relation to the length of the rod.

One end of the support rod may be defined as a free end and a mounting means is attached thereto for removable securement of the clothes hanger within the interior of the locker. Such mounting means preferably includes an elongated angularly oriented finger integrally or otherwise attached to the free end and extending outwardly therefrom. The finger includes a receiving channel also being somewhat elongated and specifically disposed and configured to receive a free outwardly extending end of a support hook or clothes hook structure normally found mounted on the vertical interior sidewalls and/or backwalls of lockers of type referred to herein. The dimension and configuration of the receiving channel and the overall orientation and size of the finger in which it is mounted are such as to orient the support hanger in a substantially horizontal orientation defining an operative position for the hanger to support slacks or other applicable articles of clothing thereon. The support arm and any article of clothing thereon therefore extends substantially transversely outward from the vertical wall on which the hook structure is secured in a removable, cantilevered attachment to the hook.

The hanger structure further includes a body portion secured to the support arm in spaced relation to the mounting means and in a preferred embodiment to be described in greater detail hereinafter, preferably at one opposite end of the support arm relative to the mounting means. The body portion may include at least one elongated connecting or brace member extending from its point of connection to the support arm angularly away from the support arm to an opposite, free end. Such free end is connected to or is formed in the configuration defining a support hook. This support hook may be of the type commonly found in conventional clothes hangers and particularly adapted to be removable supported on a clothes rod normally found in conventional closets and used to support a plurality of hangers.

Further, the support hook may further define a handle or gripping means of sufficient design and configuration to be gripped by the hand of the user and position the hanger structure in what may be termed an inverted position relative to the operative position in which the hanger is disposed when it is operatively mounted within the locker.

Accordingly, the operative position is defined by the body portion disposed in a co-planar but downwardly depending relation to the elongated support arm such that the support arm is generally considered to be the upper most exposed portion of the hanger thereby allowing a folding or draping of an article of clothing, such as slacks, thereover in the conventional configuration. However, when it is desired to carry such slacks in a supported position, the hanger may be removed from the supporting hook within the locker and oriented in what may now be termed an inverted position relative to the operative position. The inverted position has the support arm disposed at a lower most orientation but still being horizontally oriented. The support hook or member defined by the body portion now becomes the upper most member of the hanger structure and may be used as a handle means for carrying the slacks or like article of clothing in their supported position on the support arm but on an opposite longitudinal surface thereof. As set forth above, the handle means :may further define the support hook for positioning of the slacks in a closet and supporting such slacks in depending relation from a conventional elongated clothes rod.

BRIEF DESCRIPTION OF THE DRAWINGS

For a fuller understanding of the nature of the present invention, reference should be had to the following detailed description taken in connection with the accompanying drawings in which:

FIG. 1 is a perspective view of a locker type structure with the hanger structure of the present invention mounted in an operative position therein.

FIG. 2 is a front plan view of the hanger structure of the present invention in its operative position being attached to a hook structure as intended.

FIG. 3 is yet another embodiment of the mounting member associated with the hanger structure of the present invention.

Like reference numerals refer to like parts throughout the several views of the drawings.

DETAILED DESCRIPTION OF THE PREFERRED EMBODIMENT

The present invention relates to a hanger structure generally indicated as 10 as shown in FIGS. 1 and 2. The hanger structure is particularly designed to be removably attached in the interior of a locker generally indicated as 12 of the type typically found in gymnasiums or like athletic facilities and used for participants to store their belongings, including clothes, when participating in the design physical activity.

The hanger structure 10 of the present invention comprises an elongated support arm 14 of sufficient length to hang or drape slacks or other articles of clothing in a folded over relation about an upper exposed surface 16 of the support arm in a manner which reduces wrinkling of the article of clothing. The support arm has one free end generally indicated as 18 and further includes a mounting means 20 physically secured or integrally formed thereon as shown in FIG. 2. The opposite end of the support arm 14 as at 22 is integrally or otherwise attached to a body portion generally indicated as 24. The body portion includes a connecting or brace member 26 extending from the end 22 of the support arm 14 to an opposite free end as at 28. A handle means generally indicated as 30 is integrally or otherwise permanently attached to the brace member 26 at the free end 28. The handle means may also be defined in the configuration of a support hook 32 capable of being mounted on an elongated supporting rod typically found in conventional closets for the support of a plurality of conventional hangers thereon.

The mounting means 20 is specifically adapted for attachment of the hanger structure 10 in an outwardly extending somewhat cantilevered connection to a supporting hook member 34 of the type normally found on the interior of lockers 12 and supported to vertically oriented sidewalls as at 12'. The mounting means 20, in the embodiment shown in FIG. 2, comprises a somewhat elongated, angularly oriented and outwardly extending finger member 36 having a receiving channel 38 formed on the interior thereof and extending along at least a partial portion of the length thereof. The receiving channel 38 has an open receiving end as at 40 wherein both the open end 40 and the receiving channel 38 are dimensioned and configured to receive a free outer most end or extremity 35 of the support hook 34. It is important to note that the finger 36 defining the mounting means 20 is specifically disposed, dimensioned and configured relative to the support arm 14 and also in cooperation with the support hook 34 so as to maintain the support arm 14 in a horizontal orientation when the hanger structure 10 is in its operative position as shown and defined in FIG. 2 and within the locker, see FIG. 1, in the upper locker portion adjacent its ceiling.

With regard to FIGS. 2 and 4, the hanger structure 10 may also be disposed in what may be referred to an inverted position (see FIG. 4) relative to the operative position in FIG. 2. When the user of the hanger desires to transport an article of clothing from the interior of the locker, he removes the hanger and the supported article from its operative position, inverts it and uses the support hook 32 as a handle means above defined as 30. The handle means is therefore disposed as substantially the upper most portion of the hanger structure and the slacks or other article of clothing being supported is draped over and folded on an opposite longitudinal surface as at 17 extending along the length of the support arm 14.

In the embodiment of FIG. 2, the hanger structure 10 may be formed from a plastic or like, or any other applicable, material. In the embodiment of FIG. 3, the hanger structure may be formed from a metallic or any other substantially rigid material capable of support from a hook 34 in the manner described above.

Now that the invention has been described,

What is claimed is:

1. A hanger structure designed to support clothes or like articles from a wall mounted hook closely adjacent a ceiling surface above the hook and within the locker, said hanger structure comprising:

a. a support arm having a first end and a second end and having an elongate configuration of sufficient length and shape to hold an article of clothing thereover, b. said first end of said support arm comprising a free end having a mounting means formed thereon and structured for removable attachment of said hanger structure to the hook, c. said mounting means and said support arm cooperatively disposed and configured to dispose said support arm in an operative position when said mounting means is attached to the hook, d. said operative position defined by an outwardly extending substantially horizontal orientation of said support arm relative to the wall on which the hook is mounted and closely adjacent the locker ceiling, e. a body portion connected to said support arm in spaced relation to said mounting means, f. said body portion extending from the second end of said support arm outwardly therefrom and away from said mounting means when said support arm is in said operative position, g. said body portion being disposed and configured in co-planar disposition with said support arm and mounting means and said body portion depending downwardly from said support arm when said support arm is in said operative position, h. said support portion comprising a handle means for carrying the support arm and an article of clothing thereon when not attached in said operative position to the hook, i. said handle means being configured for gripping by the hand of a user and orienting said support arm in an inverted position when so gripped, j. said handle means comprising a supporting hook configured to removably support the support arm and an article of clothing thereon to a horizontally oriented clothes rod when in said inverted position relative to said operative position, k. said support arm comprising a substantially straight line configuration along its length and said body portion secured to said support arm at the second end thereof relative to said supporting means being spaced from said support arm along a major portion of the length of said support arm, l. said support arm being configured to engage the article of clothing on a first exposed surface extending along the length of said support arm when in said operative position and on a second exposed surface extending along the length of said support arm and oppositely disposed to said first surface when said support arm is in said inverted position, m. said mounting means comprising an outwardly extending angularly oriented finger extending from said first exposed surface away from said handle means, n. said mounting means comprising an elongate recess dimensioned and configured to receive an outer free end of the locker hook therein so that said support arm and said body portion extend transversely outwardly from the hook structure and in cantilevered attachment thereto when in said operative position within a locker, and said channel is formed within and extends along a length of said finger integrally formed on said free end of said support arm.

* * * * *